US010400535B1

(12) United States Patent
Greenlee

(10) Patent No.: US 10,400,535 B1
(45) **Date of Patent: *Sep. 3, 2019**

(54) RETRIEVABLE DOWNHOLE TOOL

(71) Applicant: Nine Downhole Technologies, LLC, Houston, TX (US)

(72) Inventor: Donald Roy Greenlee, Murchison, TX (US)

(73) Assignee: Nine Downhole Technologies, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/898,067

(22) Filed: Feb. 15, 2018

Related U.S. Application Data

(63) Continuation of application No. 14/666,398, filed on Mar. 24, 2015, now Pat. No. 9,915,114.

(60) Provisional application No. 61/969,713, filed on Mar. 24, 2014.

(51) Int. Cl.
*E21B 23/06* (2006.01)
*E21B 23/00* (2006.01)
*E21B 33/129* (2006.01)

(52) U.S. Cl.
CPC ..... *E21B 23/06* (2013.01); *E21B 23/00* (2013.01); *E21B 33/129* (2013.01)

(58) Field of Classification Search
CPC ..... E21B 23/06; E21B 23/00; E21B 33/129
See application file for complete search history.

(56) References Cited

U.S. PATENT DOCUMENTS

| | | | | |
|---|---|---|---|---|
| 5,224,540 | A | 7/1993 | Streich et al. | |
| 6,220,350 | B1 | 4/2001 | Brothers | |
| 7,373,973 | B2 | 5/2008 | Smith | |
| 8,267,177 | B1 | 9/2012 | Vogel et al. | |
| 8,276,670 | B2 | 10/2012 | Patel | |
| 8,668,019 | B2 | 3/2014 | Casciaro | |
| 2006/0131031 | A1* | 6/2006 | McKeachnie | E21B 33/1294 166/376 |
| 2006/0175059 | A1 | 8/2006 | Sinclair et al. | |
| 2007/0119600 | A1 | 5/2007 | Slup et al. | |
| 2010/0101807 | A1 | 4/2010 | Greenlee et al. | |
| 2011/0067889 | A1* | 3/2011 | Marya | E21B 33/134 166/386 |
| 2011/0147014 | A1 | 6/2011 | Chen et al. | |
| 2011/0277987 | A1 | 11/2011 | Frazier | |

(Continued)

OTHER PUBLICATIONS

Non-final Rejection dated Sep. 3, 2014 from related U.S. Appl. No. 13/737,068.

(Continued)

*Primary Examiner* — Waseem Moorad
*Assistant Examiner* — Neel Girish Patel
(74) *Attorney, Agent, or Firm* — Vinson & Elkins LLP

(57) ABSTRACT

A retrievable downhole tool has a mandrel, an upper radially expandable slip carried by the mandrel, a lower radially expandable slip carried by the mandrel, a rubber element disposed between the upper radially expandable slip and the lower radially expandable slip, an upper backup disposed between the upper radially expandable slip and the rubber element, and a lower backup disposed between the rubber element and the lower radially expandable slip. At least one of the upper radially expandable slip, the lower radially expandable slip, the upper backup, and the lower backup comprises a soluble material.

11 Claims, 8 Drawing Sheets

(56) References Cited

U.S. PATENT DOCUMENTS

| | | | | |
|---|---|---|---|---|
| 2011/0308820 | A1 | 12/2011 | Greenlee et al. | |
| 2012/0073827 | A1 | 3/2012 | Kenyon et al. | |
| 2014/0190682 | A1 | 7/2014 | Greelee et al. | |
| 2014/0216722 | A1 | 8/2014 | Badrak | |
| 2014/0311752 | A1* | 10/2014 | Streich | E21B 33/1204 166/376 |
| 2015/0101796 | A1 | 4/2015 | Davies et al. | |
| 2016/0138369 | A1* | 5/2016 | Tunget | E21B 37/02 166/311 |

OTHER PUBLICATIONS

Amendment dated Dec. 2, 2014 from related U.S. Appl. No. 13/737,068.

Notice of Allowance dated Dec. 3, 2014 from related U.S. Appl. No. 13/737,068.

Hyne, Norman J., Dictionary of Petroleum Exploration, Drilling & Production, 2014, 2nd Edition, p. 382.

* cited by examiner

RETRIEVABLE DOWNHOLE TOOL

BACKGROUND

Field of the Invention

The present application relates generally to downhole tools for use in well bores, as well as methods of using such downhole tools. In particular, the present application relates to downhole tools and methods for plugging a well bore.

Description of Related Art

Prior downhole tools are known, such as hydraulic fracturing plugs and bridge plugs. Such downhole tools are commonly used for sealing a well bore. These types of downhole tools typically can be lowered into a well bore in an unset position until the downhole tool reaches a desired setting depth. Upon reaching the desired setting depth, the downhole tool is radially expanded into a set configuration. Once the downhole tool is set, the downhole tool acts as a plug to seal the tubing or other pipe in the casing of the well bore.

While lowering, a downhole tool may encounter internal diameter variations within the well bore. Downhole tools are typically sized according to the internal diameter of the well bore. If variations within the well bore are severe enough, the downhole tool with either be prevented from lowering to the correct depth or may fail to fully seal. Additionally, when setting the downhole tool, excessive pressure can result on selected components of the downhole tool resulting in shear forces that exceed tool tolerances. In such applications, components within the downhole tool can shear or break away from the tool resulting in a possible failure to set and fully seal the well bore.

When it is desired to remove many of these types of tools from a well bore, it is frequently simpler and less expensive to mill or drill them out rather than to utilize multiple complex retrieving operations. In milling, a milling cutter is used to grind the plug out of the well bore. Milling can be a relatively slow process. In drilling, a drill bit is used to cut and grind up the components of the downhole tool to remove it from the well bore. Drilling is typically a much faster process as compared to milling.

Drilling out a plug typically requires selected techniques. Ideally, the operator employs variations in rotary speed and bit weight to help break up the metal parts and reestablish bit penetrations should bit penetrations cease while drilling. A phenomenon known as "bit tracking" can occur, wherein the drill bit stays on one path and no longer cuts into the downhole tool. When this happens, it is often necessary to pick up the bit above the drilling surface and rapidly re-contact the bit with the packer or plug and apply weight While continuing rotation. This aids in breaking up the established bit pattern and helps to reestablish bit penetration. However, operators may not recognize when bit tracking is occurring. Furthermore, when operators attempt to rapidly re-contact the drill bit with the downhole tool, the downhole tool may travel with the drill bit as a result of unequalized pressure within the well bore. This is seen typically as drilling has passed through the slip means, thereby decreasing the downhole tool's grip within the well bore. The result is that drilling times are greatly increased because the bit merely wears against the surface of the downhole tool rather than cutting into it to break it up. Both milling and drilling result in the downhole tool being destroyed and/or lost with no capability to reuse any portion of the downhole tool.

Although great strides have been made in downhole tools, considerable shortcomings remain.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
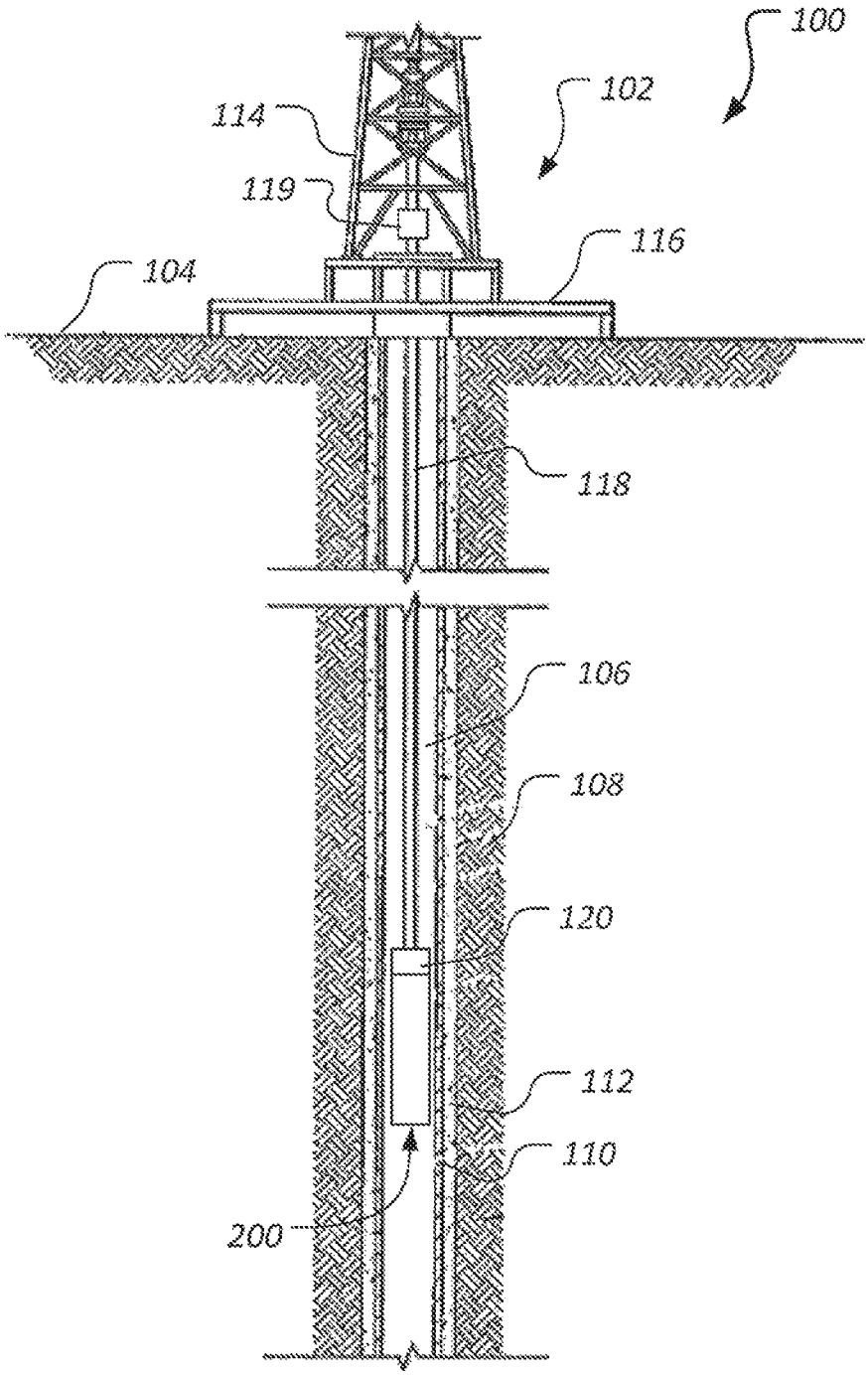
FIG. 1 is a simplified schematic view of a hydrocarbon production system according to the present application.

While the system and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

Referring now to FIG. 1 in the drawings, a schematic view of a hydrocarbon production system 100 is shown. As depicted, a drilling rig 102 is positioned on the earth's surface 104 and extends over and around a well bore 106 that penetrates a subterranean formation 108 for the purpose of recovering hydrocarbons. At least the upper portion of the well bore 106 can be lined with casing 110 that is cemented into place relative to the formation 108 using cement 112. The drilling rig 102 includes a derrick 114 with a rig floor 116 through which a cable 118, such as a wireline, jointed pipe, or coiled tubing, for example, extends downwardly from the drilling rig 102 into the well bore 106. The cable 118 suspends a setting tool 120 that carries a retrievable downhole tool 200, which comprises a hydraulic fracturing plug. In alternative embodiments, the retrievable downhole tool can comprise a bridge plug, a packer, or another type of wellbore zonal isolation device. The retrievable downhole tool 200 is shown in an unexpanded state suitable for lowering the retrievable downhole tool 200 into the well bore 106 and retrieving the retrievable downhole tool 200 from the well bore 106. The drilling rig 102 is conventional and includes a motor driven winch and other associated equipment for extending the cable 118 into the well bore 106 to position the retrievable downhole tool 200. In some embodiments, the hydrocarbon production system 100 comprises a lubricator device 119 that assist in feeding the cable 118 into the well bore 106 by introducing lubricants into the well bore 106 along with the cable 118. In some cases, the lubricator device 119 supports weight of the cable 118 and the components carried by the cable 118. In some embodiments, the lubricator device comprises a high-pressure grease-injection section and sealing elements. The lubricator device 119 can receive tools and/or equipment to be sent downhole and can pressurize a space around the tools and/or equipment and enable the tools and/or equipment to fall or be pumped into the well bore 106 under pressure.

Figure 2:
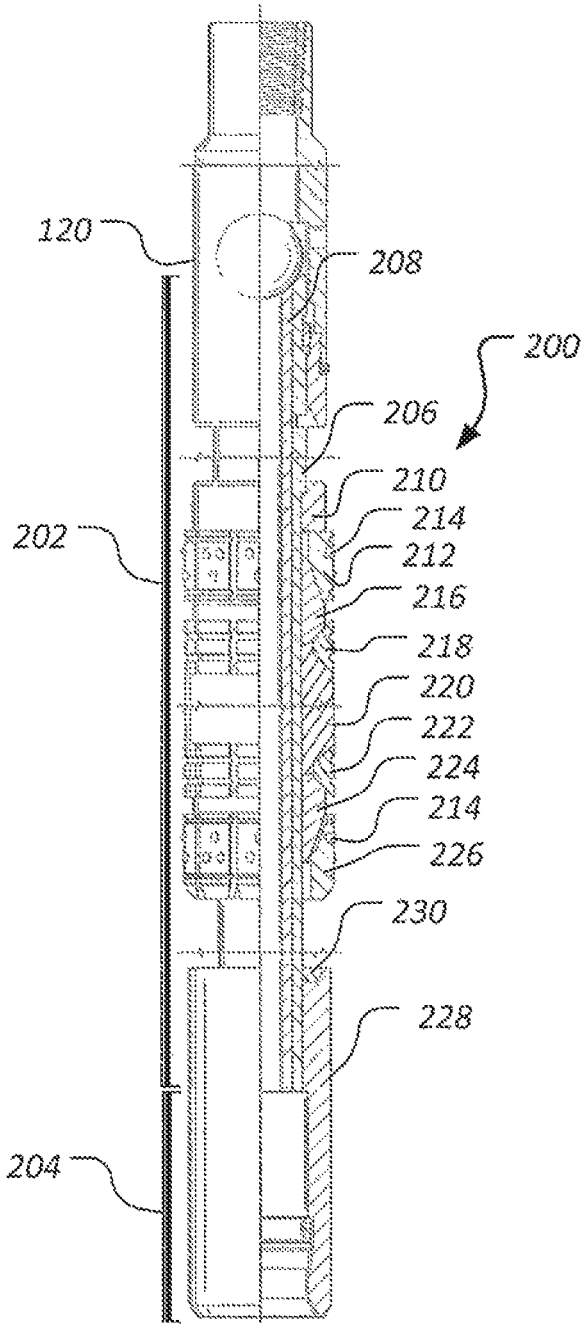
FIG. 2 is a one quarter sectional view of a retrievable downhole tool of the hydrocarbon production system of FIG. 1.
Figure 3A:
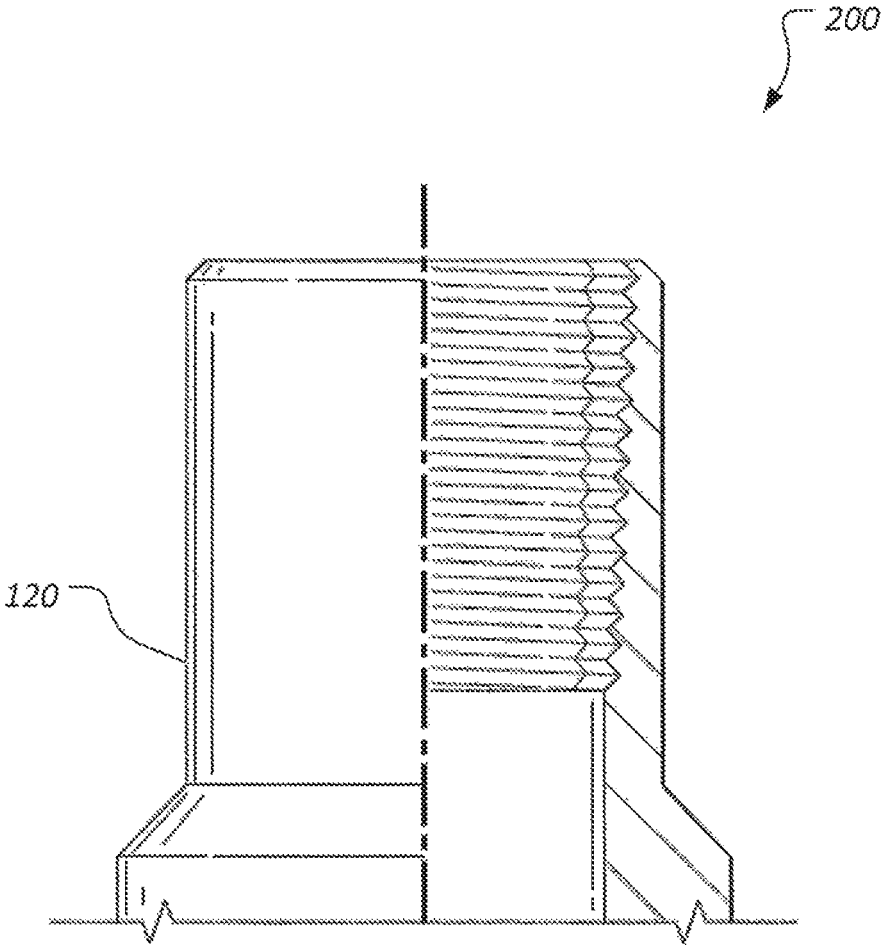
FIGS. 3A-3E are enlarged one quarter sectional views of the retrievable downhole tool of FIG. 2.
Figure 3B:
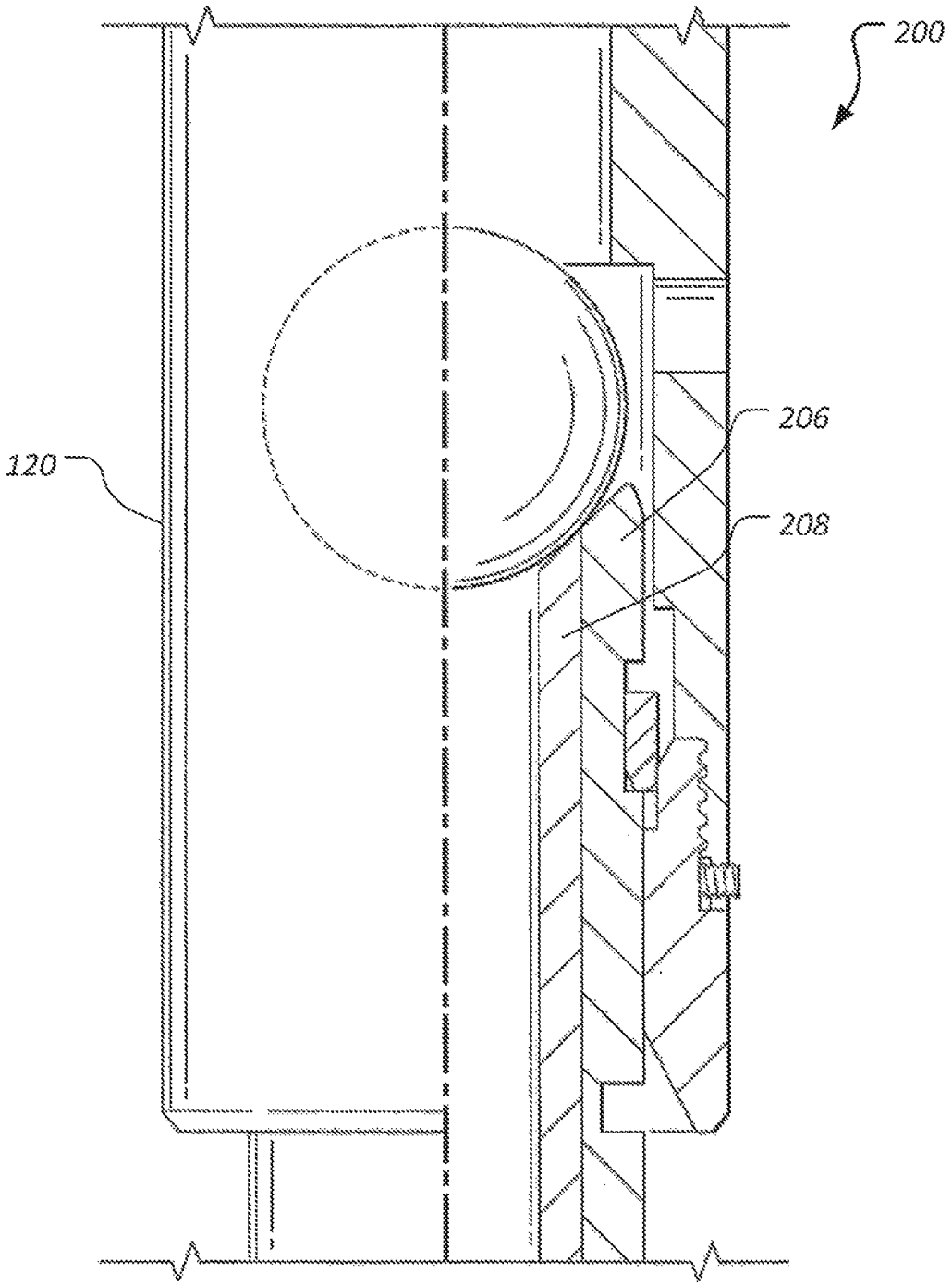
Figure 3C:
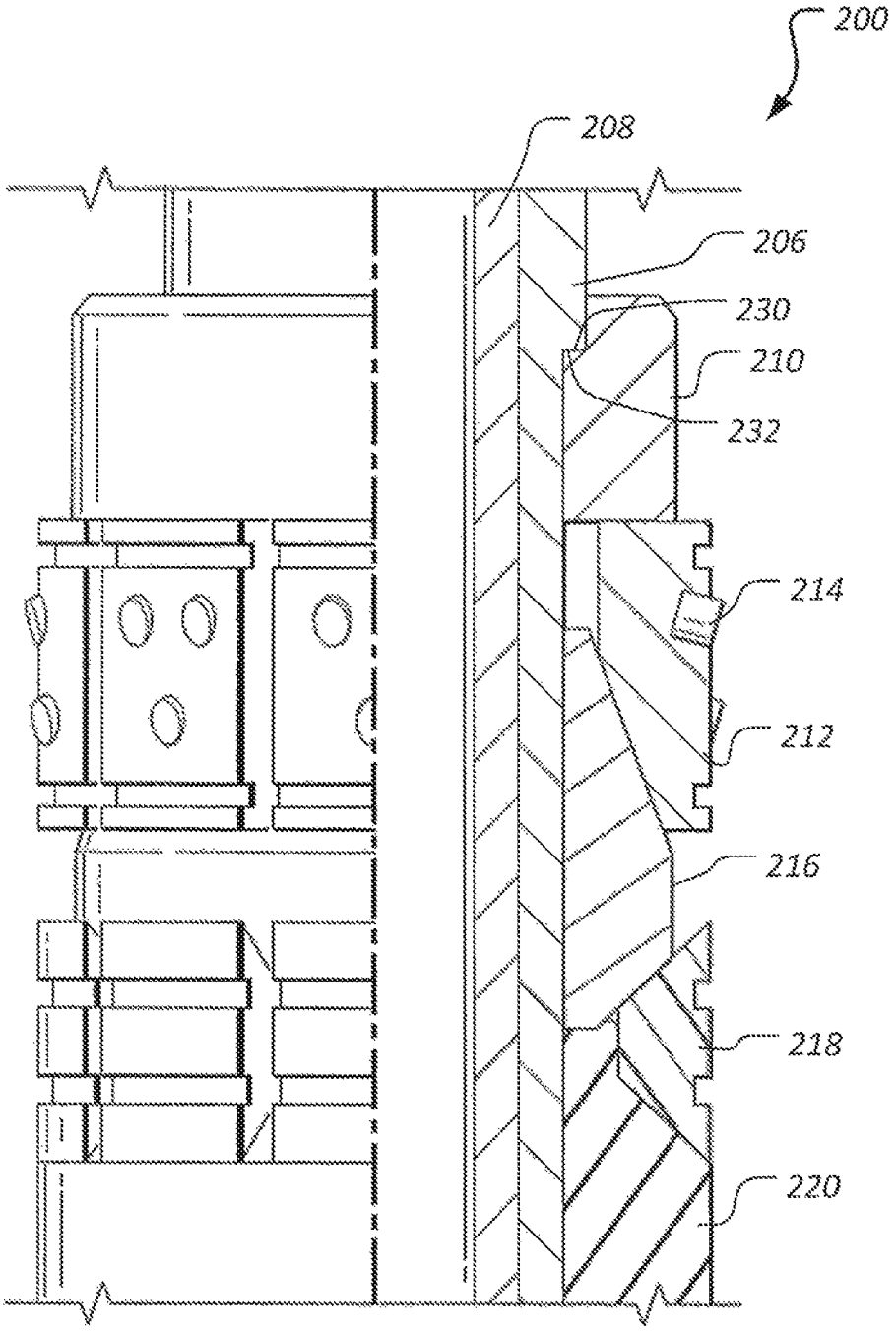
Figure 3D:
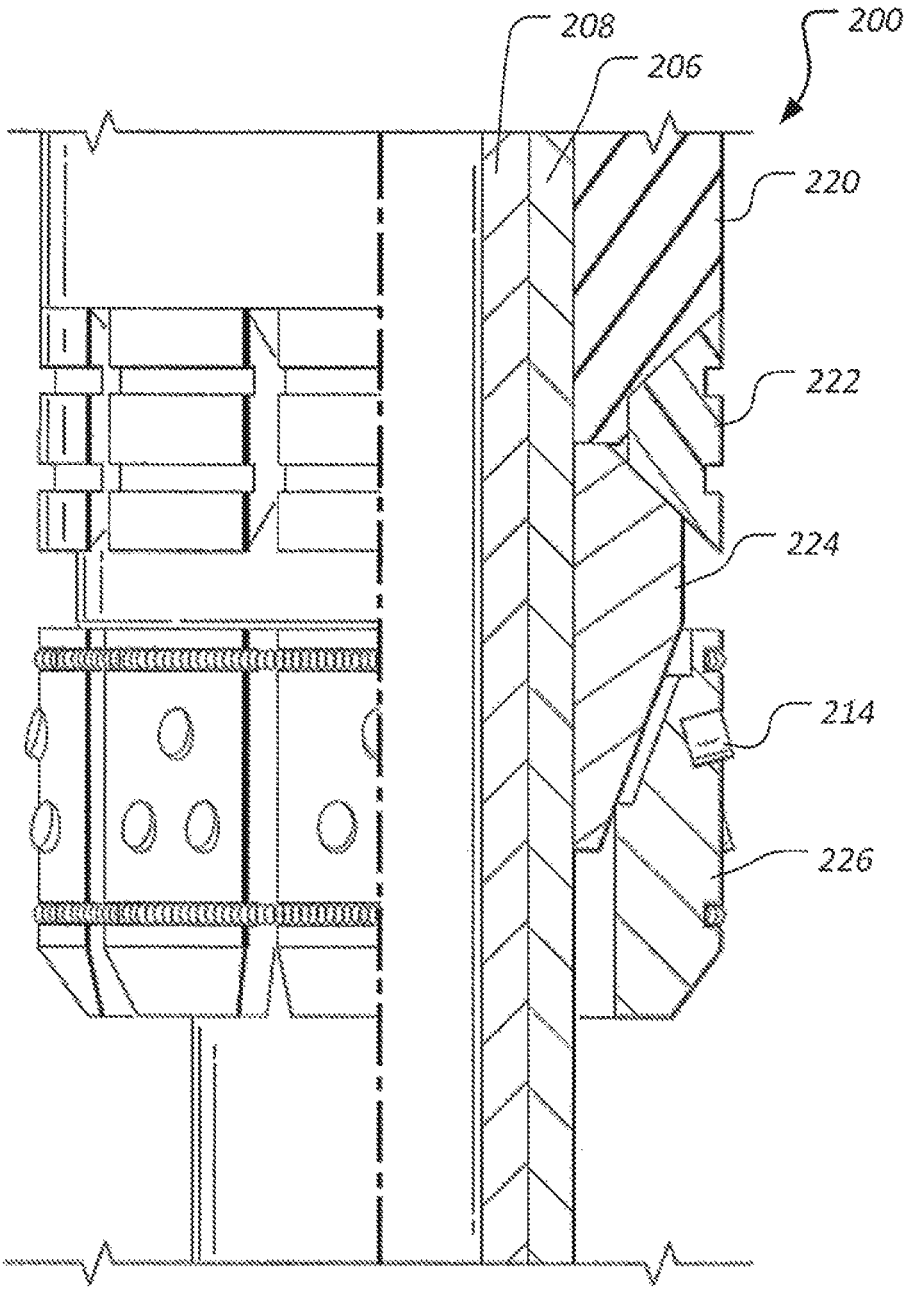
Figure 3E:
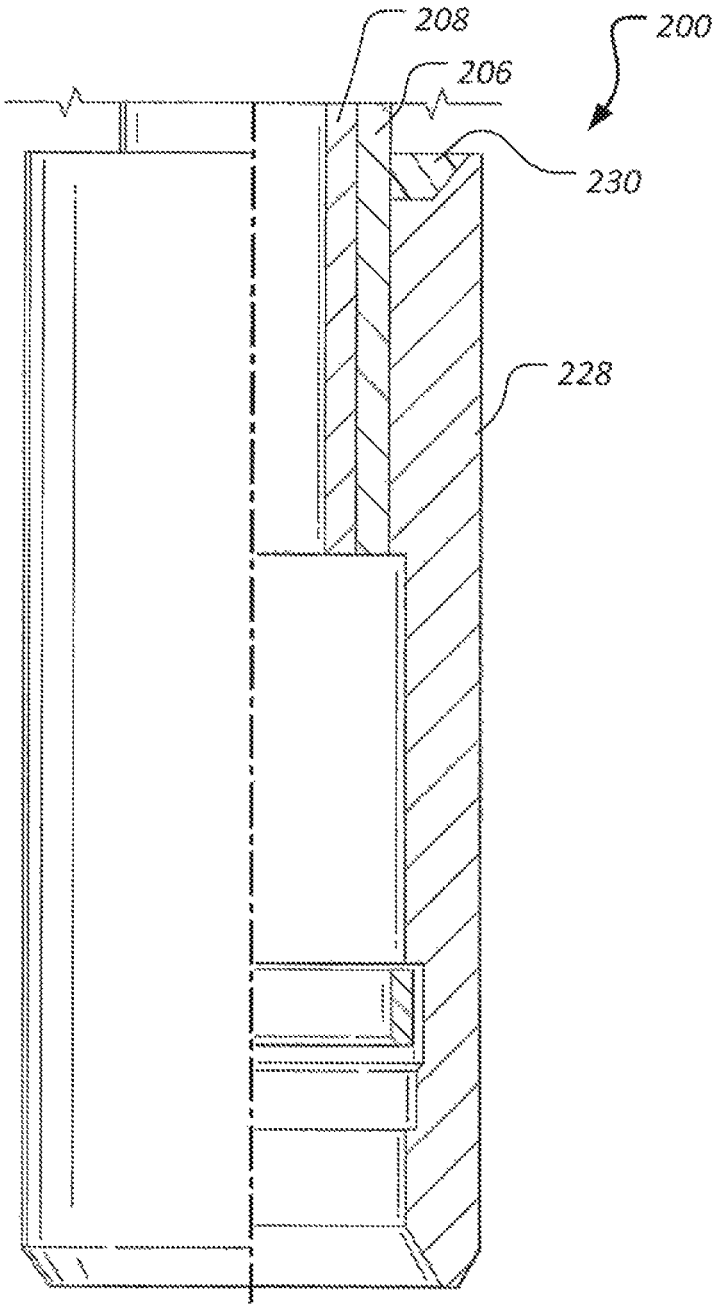

Referring now to FIGS. 2-3E in the drawings, the retrievable tool 200 generally comprises a hydraulic fracturing plug 202 and an integrated retrieval tool 204. The retrievable tool 200 is shown attached to a retrieval tool 120. The retrieval tool 200 comprises a tubular mandrel 206 that carries other components of the retrieval tool 200. A hollow pultruded rod 208 is carried within the mandrel 206. A setting ring 210, a soluble slip 212 carrying teeth 214, an upper cone 216, upper soluble backups 218, an elastomeric sealing element 220, lower soluble backups 222, a lower cone 224, and a lower slip 226 carrying teeth 214 are also carried by the mandrel 206.

When the retrievable tool 200 is located at a desired depth within the well bore 106, the retrievable tool 200 is activated to sealingly engage the interior walls of the well bore 106. When activated, retrievable tool 200 engages the well bore 106 and separates two distinct volumes relative to the retrievable tool 200. Pultrusion rod 208 is located within a central opening of the mandrel 206. Pultrusion rod 208 can be either pinned or glued within the mandrel 206. Some embodiments may use both a glue and a pin to secure pultrusion rod 208. An adhesive, such as glue, provides an additional benefit of sealing the space between pultrusion rod 208 and the mandrel 206. Pultrusion rod 208 is configured to provide internal support to the mandrel 206 as well as guide shoe 228 which is carried by a lower end of the mandrel 206.

The setting ring 210 is located around the mandrel 206 is adjacent upper soluble slip 212. The setting ring 210 comprises a ledge 230 formed to complement a shoulder 232 of the mandrel 206. The shoulder 232 is configured to prevent the setting ring 210 from sliding off of mandrel 206. A lower surface of the setting ring 210 abuts an upper surface of the upper soluble slip 212. The upper soluble slip 212 has a lower surface that can contact one or more set screws that prevent the upper soluble slip 212 from translating up a the upper cone 216 prior to activation of the retrievable tool 200. The upper soluble slip 212 comprises a plurality of separate soluble slip components, each comprising 8 soluble material such as, but not limited to, poly vinyl acetate (PVA) and/or any other suitable water soluble material. The slip components further comprise channels 234 for receiving retaining members, such as, but not limited to, composite or metallic bands or wires that extend at least partially around the slip components to hold the slip components in place prior to activation of the retrievable tool 200.

During activation of the retrievable tool 200, the upper soluble slip 212 translates down cone 216 causing each slip component to separate in a radial fashion about a central axis of the mandrel 206. During activation, each retaining member is configured to break, thereby permitting the outward spreading of the slip components. The teeth 214 are molded into the slip components of the upper soluble slip 212 so that a radially outer portion of each tooth 214 protrudes from the upper soluble slip 212. The teeth 214 are configured to selectively engage the well bore 106 when the retrievable tool 200 is set or activated. While shown as substantially cylindrical, various shapes of teeth 214 may be utilized. Teeth 214 can comprise any suitable hard material, such as, but not limited to, hardened steel or ceramic.

In some embodiments, the lower slip 226 an comprise a thermoset composite plastic or metal, such as cast iron, or any other material suitable for withstanding relatively high fluid pressures, such as up to 120 ksi. In such cases, the metal and/or composite components may be reused after retrieved from the well bore 106. Alternatively, the lower slip 226 can be formed of a soluble material so long as the selected material is capable of withstanding the above-mentioned high fluid pressures. Regardless of the construction material, the lower slip 226 comprises slip components that operate in a manner substantially similar to the slip components of upper soluble slip 212 insofar as the slip components carry teeth 214 and are configured to selectively move radially outward to engage the well bore 106.

The guide shoe 228 comprises a soluble ring 230 comprising one or more of the above-described soluble materials. The soluble ring 230 is configured to dissolve when exposed to hydraulic fracturing fluids so that when the soluble ring 230 is sufficiently destabilized, the soluble ring 230 can be displaced from the guide shoe 228 by the slip components of the lower slip 226. When the slip components of the lower slip 226 occupy the space formerly occupied by the soluble ring 230, the previously radially extended components of the retrievable downhole tool 200 are provided additional opportunity to retract radially inward to unset the retrievable downhole tool 200 and allow removal of the retrievable downhole tool 200 from the wellbore. As described below, some combination of degradation of the one or more soluble components of the retrievable downhole tool 200 collectively provide the possibility of automatically unsetting the retrievable downhole tool 200 as a function of exposing the soluble components to the fracturing fluids.

While the retrievable tool 200 is shown as comprising an integrated retrieval tool 204, it will be appreciated that alternative embodiments of the retrievable tool 200 do not comprise the integrated retrieval tool 204. As explained below in more detail, in a hydrocarbon production system 100 comprising multiple retrievable downhole tools 200 positioned within a single well bore 106, is some cases, the lowest located retrievable downhole tool 200 can be provided without the integrated retrieval tool 204.

Figure 4A:
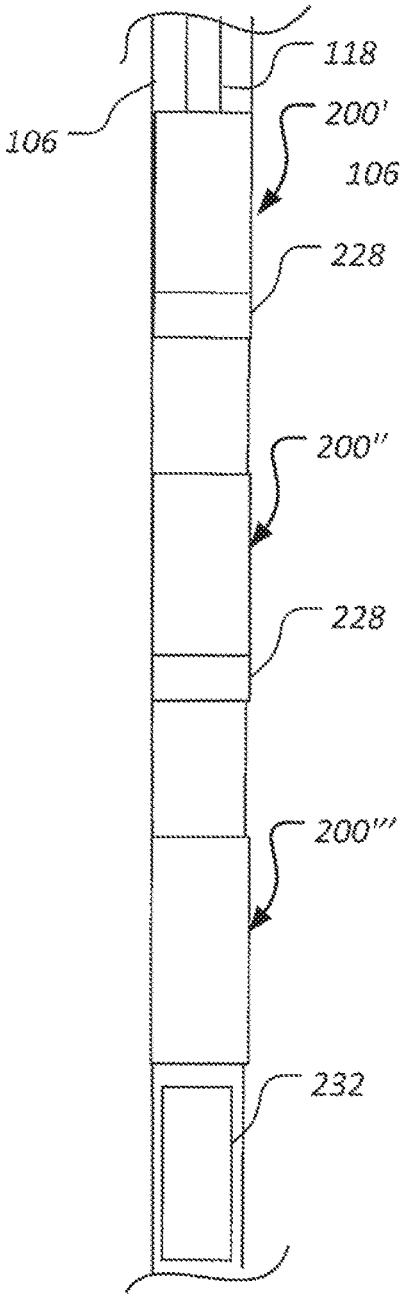
FIGS. 4A-4C are simplified schematic views of retrievable downhole tools disposed in a wellbore at various stages of retrieval.
Figure 4B:
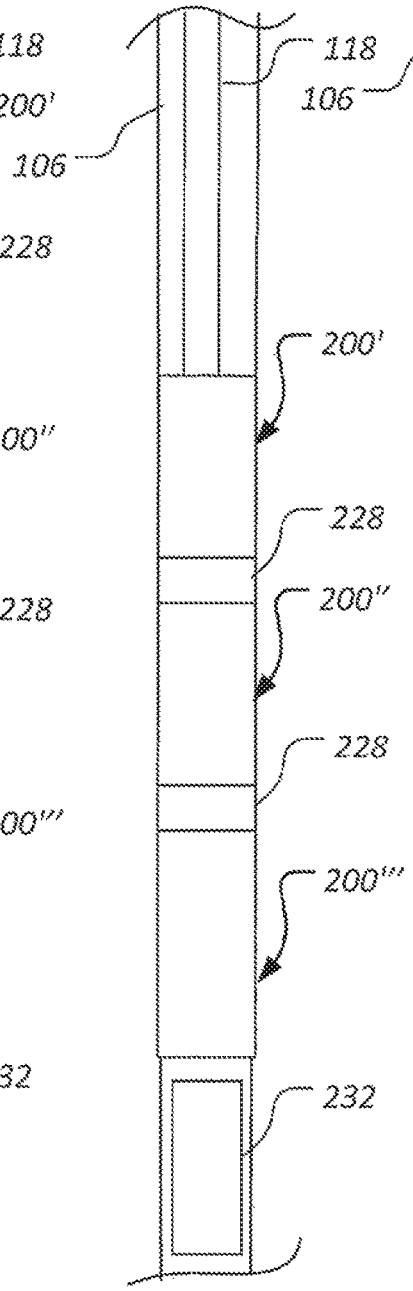
Figure 4C:
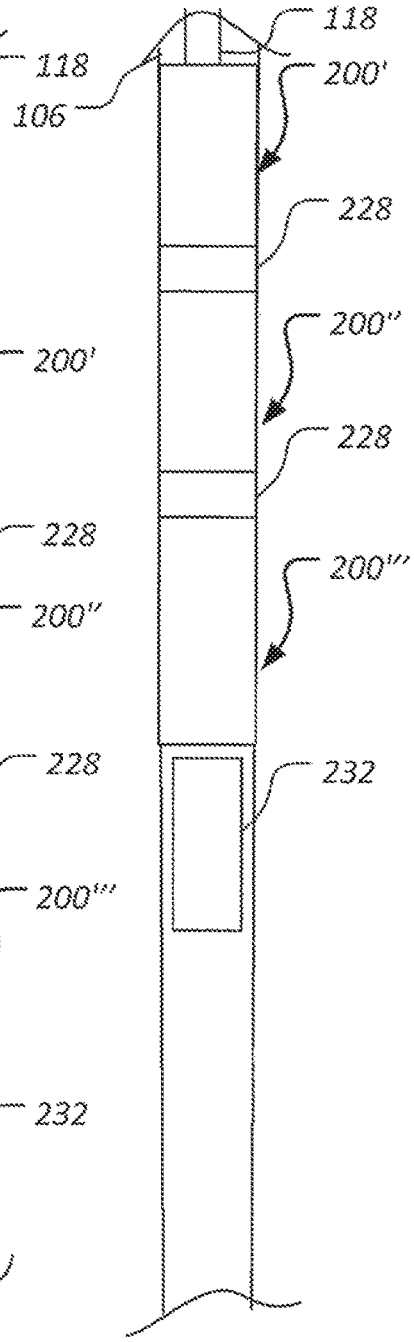

Referring now to FIGS. 4A-4C, the steps of removing multiple retrievable downhole tools 200 from a well bore 106 are shown. FIG. 4A depicts three retrievable downhole tools 200 disposed in a well bore 106, each in a state where one or more soluble components has degraded so that the tools 200 are ready for retrieval. As shown, an uppermost retrievable downhole tool 200' and a middle retrievable downhole tool 200" comprise integrated retrieval tools 204 while a lowest retrievable downhole tool 200'" does not comprise an integrated retrieval tool 204. However, a pig 232 is located within the well bore 106 downhole relative to the lowest retrievable downhole tool 200'". FIG. 4B shows the three retrievable downhole tools 200 connected together for removal from the well bore 106. More specifically, FIG. 4B shows that the cable 118 has been lowered to connect the uppermost retrievable downhole tool 200' to the middle retrievable downhole tool 200" via the integrated retrieval tool 204 of the uppermost retrievable downhole tool 200'. Similarly, the middle retrievable downhole tool 200" is connected to the lowest retrievable downhole tool 200'" via the integrated retrieval tool 204 of the middle retrievable downhole tool 200". FIG. 4C shows that with the three retrievable downhole tools 200 coupled to each other, the cable 118 can be raised to remove all three retrievable downhole tools 200 in a single trip. In alternative embodiments where the retrievable downhole tools 200 are each sufficiently loosely disposed in the well bore 106 as a function of significant degradation of the soluble components, well pressure emanating from below the pig 232 may force the pig 232 upward into contact with the lowest retrievable downhole tool 200'", the lowest retrievable downhole tool 200' upward into contact with the middle retrievable downhole tool 200", and the middle retrievable downhole tool 200" upward into contact with the uppermost retrievable downhole tool 200'. The fluid pressure below the pig 232 may force all three retrievable downhole tools 200 upward toward the surface and/or out of the well bore 106 without the need to trip the cable 118 down into contact with any of the retrievable downhole tools 200.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A hydrocarbon production system, comprising:

a first downhole tool disposed in a well bore, the first downhole tool being an uppermost retrievable tool, the first downhole tool comprising:

a first mandrel;

a first upper slip carried by the first mandrel, the first upper slip being radially expandable;

a first lower slip carried by the first mandrel, the first lower slip being radially expandable;

a first rubber element disposed between the first upper slip and the first lower slip;

a first upper backup disposed between the first upper slip and the first rubber element; and a first lower backup disposed between the first rubber element and the first lower slip;

a second downhole tool disposed in the well bore below the first downhole tool, the second downhole tool being a lowest retrievable tool, the second downhole tool further comprising:

a second mandrel;

a second upper slip carried by the second mandrel, the second upper slip being radially expandable;

a second lower slip carried by the second mandrel, the second lower slip being radially expandable;

a second rubber element disposed between the second upper slip and the second lower slip;

a second upper backup disposed between the second upper slip and the second rubber element; and a second lower backup disposed between the second rubber element and the second lower slip;

wherein the first upper backup and the first lower backup comprise a first soluble material;

wherein at least one of the first upper slip, the first lower slip, the second upper slip, the second lower slip, the second upper backup, and the second lower backup comprise a second soluble material, the hydrocarbon production system further comprising:

a pig disposed in the well bore below the second downhole tool, wherein the first soluble material is different from the second soluble material.

2. The hydrocarbon production system of claim 1, wherein the first downhole tool comprises an integrated retrieval tool.

3. The hydrocarbon production system of claim 2, wherein the integrated retrieval tool is configured for coupling to the second downhole tool.

4. A method of operating a hydrocarbon production system, the method comprising:

disposing a downhole tool in a well bore, the downhole tool being retrievable and further comprising:

a mandrel;

an upper slip carried by the mandrel, the upper slip being radially expandable;

a lower slip carried by the mandrel, the lower slip being radially expandable;

a rubber element disposed between the upper slip and the lower slip;

an upper backup disposed between the upper slip and the rubber element; and a lower backup disposed between the rubber element and the lower slip; and disposing a pig in the well bore downhole relative to the retrievable downhole tool, wherein the upper backup and the lower backup comprise a soluble material; and wherein at least one of the upper slip and the lower slip comprises a water soluble material.

5. The method of claim 4, further comprising:

exposing the soluble material to a fracturing fluid.

6. The method of claim 5, further comprising:

retrieving the retrievable downhole tool.

7. The method of claim 6, wherein retrieving the retrievable downhole tool further comprises:

retrieving the retrievable downhole tool using a cable.

8. The method of claim 4, further comprising:

flowing the pig upward within the well bore and into contact with the retrievable downhole tool.

9. The method of claim 1, wherein the first soluble material is water soluble.

10. The method of claim 1, wherein the second soluble material is water soluble.

11. The method of claim 4, wherein the upper slip and the lower slip comprise different materials.

* * * * *